US005094145A

United States Patent [19]

Wakabayashi et al.

[11] Patent Number: 5,094,145

[45] Date of Patent: Mar. 10, 1992

[54] HYDRAULIC PUMP OR MOTOR WITH ROTARY CYLINDER BARREL

[75] Inventors: Kiyoshi Wakabayashi, Okazaki; Masami Sakamoto, Aichi; Tsuyoshi Handa, Okazaki; Hidenobu Yamaguchi, Handa, all of Japan

[73] Assignee: Toyooki Kogyo Kabushiki Kaisha, Okashi, Japan

[21] Appl. No.: 580,561

[22] Filed: Sep. 11, 1990

[30] Foreign Application Priority Data

Sep. 11, 1989 [JP] Japan ..... 235149

[51] Int. Cl.[5] ..... F01B 3/00

[52] U.S. Cl. ..... 91/486; 91/489; 91/505; 417/222 R; 417/307; 184/6.17

[58] Field of Search ..... 91/506, 505, 486, 489; 417/222, 307; 184/6.17

[56] References Cited

U.S. PATENT DOCUMENTS

| | | | |
|---|---|---|---|
| 1,794,946 | 3/1931 | Crain | 91/489 |
| 2,939,477 | 6/1960 | Kaldobsky | 137/204 |
| 3,066,609 | 12/1962 | Hann | 91/489 |
| 3,289,605 | 12/1966 | Funk et al. | 91/486 |
| 3,289,606 | 12/1966 | Bosch | 91/489 |
| 3,657,970 | 4/1972 | Kobayashi et al. | 91/485 |
| 3,799,033 | 3/1974 | Pruvot | 91/489 |
| 4,030,404 | 6/1977 | Meijer | 91/506 |
| 4,843,950 | 7/1989 | Heyl | 91/12.2 |
| 4,967,555 | 11/1990 | Maki et al. | 91/489 |

FOREIGN PATENT DOCUMENTS

| | | | |
|---|---|---|---|
| 1333019 | 9/1962 | France | 91/506 |

*Primary Examiner*—Richard A. Bertsch
*Assistant Examiner*—Michael I. Kocharov
*Attorney, Agent, or Firm*—Fleit, Jacobson, Cohn, Price, Holman & Stern

[57] ABSTRACT

A hydraulic pump or motor having a rotary cylinder barrel formed with a plurality of cylinders in which a corresponding number of plungers are axially slidably disposed for reciprocation and a valve plate in frictional engagement with an end face of the cylinder barrel and being formed with a suction slot and a discharge slot to be communicated with the cylinders of the barrel, wherein the cylinder barrel is contained within a cavity formed in a housing having an end wall formed with an inlet passage in open communication with the suction slot of the valve plate and an outlet passage in open communication with the discharge slot of the valve plate, and a fluid control valve assembly is disposed in the end wall of the housing to permit the flow of hydraulic fluid supplied therethrough into the cavity of the housing from the outlet passage when applied with the pressure of hydraulic fluid higher than a predetermined value. A discharge hole is formed in a peripheral wall of the housing to discharge the hydraulic fluid supplied in excess into the cavity of the housing from the outlet passage under control of the fluid control valve assembly.

3 Claims, 3 Drawing Sheets

HYDRAULIC PUMP OR MOTOR WITH ROTARY CYLINDER BARREL

BACKGROUND OF THE INVENTION

1. Field of the Invention

The present invention relates to hydraulic pumps or motors, and more particularly to a hydraulic pump or motor with a rotary cylinder barrel for plungers to axially reciprocate.

2. Description of the Prior Art

As shown in FIG. 2 of the drawings, a conventional axial plunger pump or motor includes a housing 3 composed of a housing body 1 closed by an end wall block 2 secured thereto in a fluid-tight manner to form therein a cavity 3A to be filled with hydraulic fluid for lubrication. Disposed within the housing cavity 3A is a rotary cylinder barrel 5 which is splined to a drive shaft 4 rotatably mounted within the housing 3. The cylinder barrel 5 is formed with a plurality of circumferentially equally spaced cylinders 5A in which a corresponding number of plungers 11 are axially slidably disposed for reciprocation. The cylinder barrel 5 is axially movable on the drive shaft 4 and has a forward end face slidable in contact with a valve plate 6 under the load of a compression coil spring supported thereon. The valve plate 6 is secured in place to an internal surface of the end wall block 2, the valve plate being formed with a semi-circular suction slot 8 and a semi-circular discharge slot 10 respectively in open communication with inlet and outlet passages 7 and 9 in the end wall block 2. The suction and discharge slots 8 and 10 are arranged to be communicated with the barrel cylinders 5A for suction and discharge operation of hydraulic fluid. An inclined swash plate 14 is tiltably supported at its opposite sides on the housing body 1 for frictional engagement with shoes coupled with each spherical head of plungers 11. During rotation of the cylinder barrel 5, frictional engagment of the plunger shoes on the inclined swash plate 14 causes pumping action by reciprocating the plungers 11 in the barrel cylinders 5A.

In the axial plunger pump or motor, the housing cavity 3A is filled with lubricant of the same kind as hydraulic fluid supplied into the barrel cylinders 5A for lubrication of sliding portions between the cylinder barrel 5 and valve plate 6 and between the swash plate 14 and plunger shoes. The hydraulic fluid supplied in excess into the housing cavity 3A is discharged to the exterior through discharge holes 3B in the peripheral wall of housing body 1. For supply of the lubricant, an oil supply plug 13 is threaded into a shoulder of housing body 1 to be manually removed when it is desired to supply the lubricant into the housing cavity 3A. In the case that the plunger pump or motor is installed in a limited space, however, the operation for supply of the lubricant becomes very difficult and troublesome.

SUMMARY OF THE INVENTION

It is, therefore, a primary object of the present invention to provide an improved axial plunger pump or motor wherein the lubricant can be automatically supplied into the housing cavity in operation without any manual operation.

According to the present invention, the object is attained by providing a hydraulic pump or motor having a rotary cylinder barrel formed with a plurality of cylinders (in which a corresponding number of plungers are axially slidably disposed for reciprocation) and a valve plate in frictional engagement with an end face of the cylinder barrel and being formed with a suction slot and a discharge slot to be communicated with the cylinders of the barrel, wherein the cylinder barrel is disposed within a cavity formed in a housing having an end wall formed with an inlet passage in open communication with the suction slot of the valve plate and an outlet passage in open communication with the discharge slot of the valve plate and being formed at its peripheral wall with a discharge hole in open communication with the cavity of the housing, and wherein a fluid control valve assembly is disposed in the end wall of the housing to permit the flow of hydraulic fluid supplied therethrough into the cavity of the housing from the outlet passage when applied with the pressure of hydraulic fluid higher than a predetermined value. The discharge hole is arranged to discharge the hydraulic fluid supplied in excess into the cavity of the housing from the outlet passage under control of the fluid control valve assembly.

BRIEF DESCRIPTION OF THE DRAWINGS

Other objects, features and advantages of the present invention will be readily appreciated by the following detailed description of a preferred embodiment thereof when taken together with the accompanying drawings, in which.

DESCRIPTION OF THE PREFERRED EMBODIMENT

Figure 1:
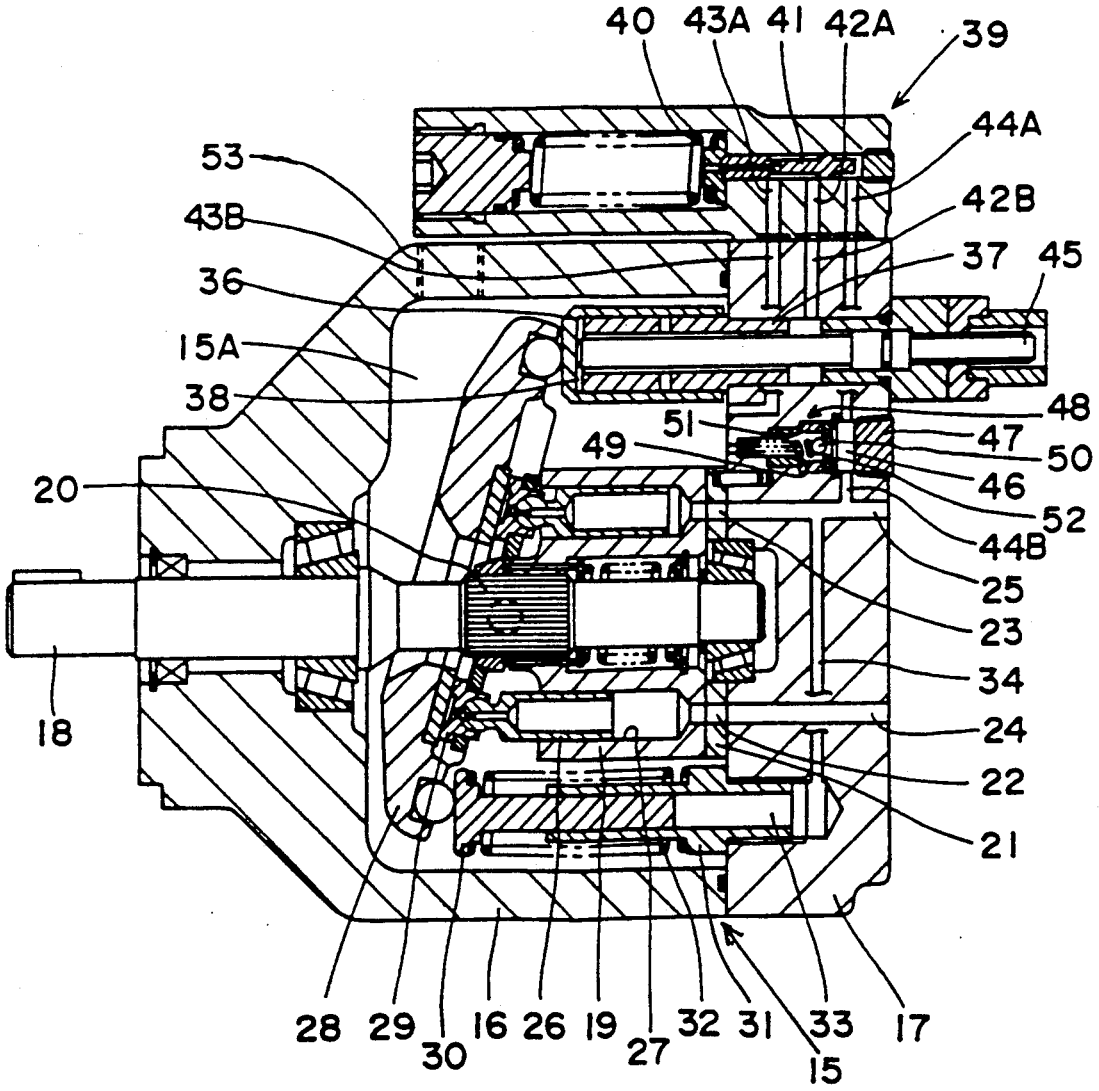
FIG. 1 is a vertically cross-sectional view of a hydraulic axial plunger pump or motor in accordance with the present invention.
Figure 2:
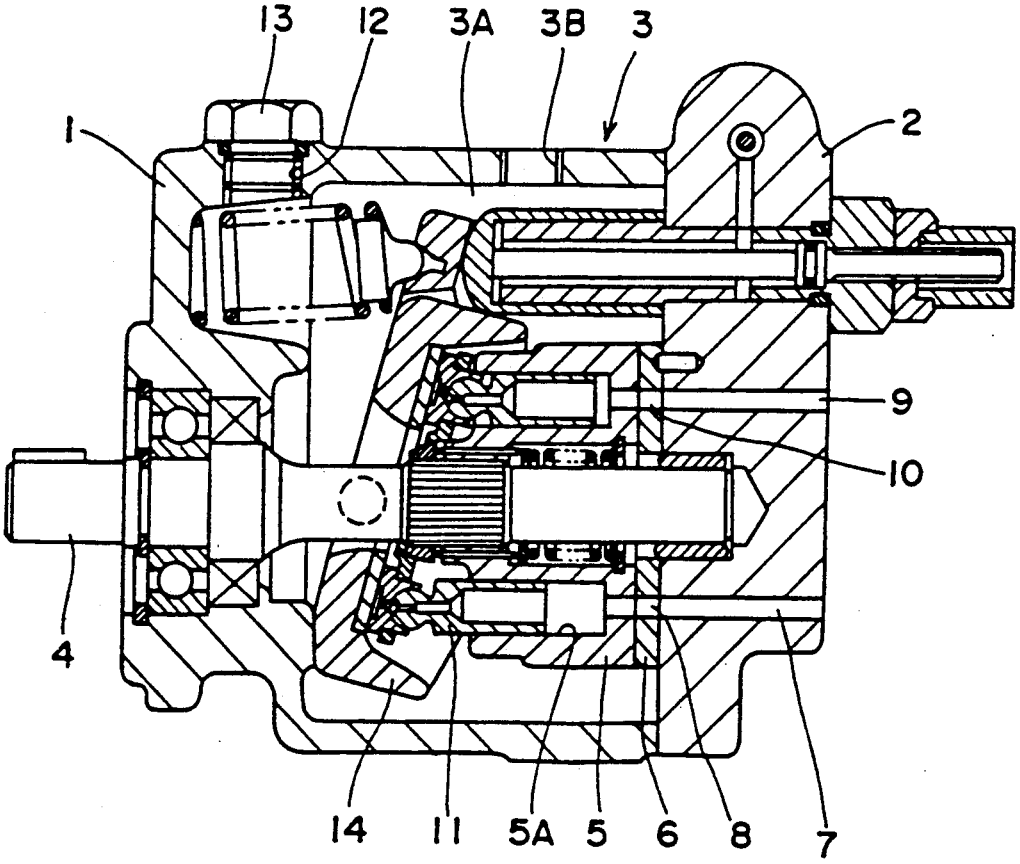
Fig. 2 (PRIOR ART)
FIG. 2 is a vertically cross-sectional view of a conventional axial plunger pump or motor.

In FIG. 1 of the drawings, there is illustrated a hydraulic axial plunger pump or motor which includes a housing 15 composed of a housing body 16 closed by an end wall block 17 secured thereto in a fluid-tight manner to form therein a cavity 15A to be filled with hydraulic fluid for lubrication. Disposed within the housing cavity 15A is a rotary cylinder barrel 19 which is splined at 20 to a drive shaft 18 rotatably mounted within the housing 15. The cylinder barrel 19 is formed with a plurality of circumferentially equally spaced cylinders 27 in which a corresponding number of plungers 26 are axially slidably disposed for reciprocation. The cylinder barrel 19 is axially movable on the drive shaft 18 and has a forward end face slidable in contact with a valve plate 21 under the load of a compression coil spring supported thereon. The valve plate 21 is secured in place to a internal surface of the end wall block 17, the valve plate 21 being formed with a semi-circular suction slot 22 and a semi-circular discharge slot 23, respectively, in open communication with inlet and outlet passages 24 and 25 formed in end wall block 17. The suction and discharge slots 22 and 23 are arranged to be communicated with the cylinders 27 in barrel 19 for suction and discharge operation of hydraulic fluid. The plungers 26 are each provided at their spherical heads with a shoe 29 which is maintained in frictional engagement with an inclined swash plate 28 under the pressure of hydraulic fluid supplied into the barrel cylinders 27. The inclined swash plate 28 is tiltably supported at its opposite sides on the housing body 16 to cause pumping action by reciprocating the plungers 26 during rotation of the cylinder barrel 19. The inclined angle of swash plate 28 is adjustable to vary the displacement capacity of plungers 26 in barrel cylinders 27.

The axial plunger pump or motor further includes a thrust piston 30 which is axially slidably disposed in a cylindrical guide member 31 secured at its one end to the end wall block 17. The thrust piston 30 is maintained in engagement with the swash plate 28 through a ball under the load of a compression coil spring 32 supported thereon and is urged toward the swash plate 28 by the pressure of hydraulic fluid supplied into an axial bore 33 of guide member 31 from the outlet passage 25 through a passage 34. Thus, the thrust piston 30 acts to define a maximum inclined angle of the swash plate 28 in operation. A hollow piston 36 is axially slidably coupled over a cylindrical support member 37 secured a its one end to the end wall block 17. The hollow piston 36 is received at its internal end wall by an adjusting bolt 45 threaded into the end wall block 17 for engagement with the swash plate 28 through a ball. A fluid chamber 38 formed in hollow piston 36 has a pressure receiving area larger than that of the thrust piston 30. Thus, the hollow piston 36 is urged toward the swash plate 28 by the pressure of hydraulic fluid supplied into the fluid chamber 38 through passages 42A, 42B in such a manner as described later.

A pressure control valve assembly 39 is mounted on the end wall block 17 to control the hydraulic fluid under pressure supplied from the outlet passage 25 into the fluid chamber 38 in hollow piston 36. The control valve assembly 39 includes a valve casing formed with passages 44A, 42A and 43A respectively in open communication with passages 44B, 42B and 43B formed in the end wall block 17 and a valve element 41 axially slidably disposed within an axial bore in open communication with the passages 44A, 42A and 43A. The valve element 41 is retained in a first position under the load of a compression coil spring 40 to communicate the passages 42A, 42B with the housing cavity 15A through the passages 43A, 43B and to interrupt a communication between the passages 44A, 44B and 42A, 42B. When the hydraulic pressure acting on the valve element 41 exceeds the load of compression coil spring 40, the valve element 41 is moved leftward to communicate the passages 42A, 42B with the passages 44A, 44B and to interrupt the communication between the passages 42A, 42B and 43A, 43B. Thus, the hollow piston 36 is retained in a retracted position when the pressure in outlet passage 25 is less than a predetermined value defined by the load of compression coil spring 40 acting on the valve element 41. In such a condition, the swash plate 28 is inclined at the maximum angle under the pressure acting on the thrust piston 30. When the pressure in outlet passage 25 exceeds the predetermined value, the hollow piston 36 is moved leftward by the hydraulic pressure applied thereto through the presssure control valve assembly 39 against the pressure acting on the thrust piston 30. In this condition, the swash plate 28 is positioned at a minimum inclined angle to minimize the displacement stroke of plungers 26 thereby to minimize the discharge amount of hydraulic fluid.

Figure 3:
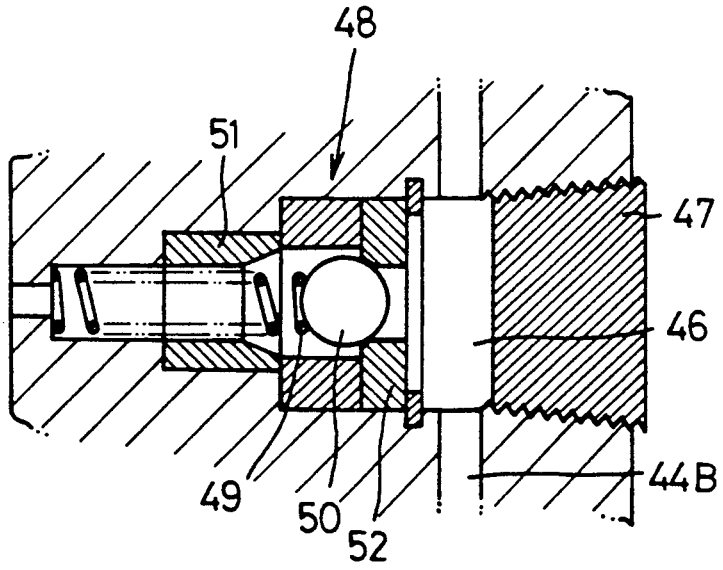
FIG. 3 is an enlarged sectional view of a fluid control valve assembly shown in FIG. 1.

A stepped axial bore 46 is formed in the end wall block 17 for providing a communication between the passage 44B and the housing cavity 15A, the axial bore 46 being closed at one end thereof by means of a closure plug 47 threaded into end wall block 17. Disposed within the stepped bore 46 is a fluid control valve assembly 48 which includes a valve element in the form of a ball 50 loaded by a compression coil spring 49 for engagement with a support plate 52 secured in place within the stepped bore 46. As clearly shown in FIG. 3, the valve element 50 is maintained in engagement with the support plate 52 to interrupt the flow of hydraulic fluid into the housing cavity 15A through an axial hole in support plate 52 in a condition where it is applied with hydraulic pressure less than a predetermined value defined by the load of compression coil spring 49. When the hydraulic pressure acting on the valve element 50 exceeds the predetermined value, the valve element 50 is moved against the load of compression coil spring 49 to permit the flow of hydraulic fluid supplied into the housing cavity 15A through the axial hole of support plate 52 and is brought into engagement with a valve seat 51 in bore 46 to interrupt the flow of hydraulic fluid into the housing cavity 15A. The hydraulic fluid supplied in excess into the housing cavity 15A is discharged to the exterior through discharge holes 53 in an upper portion of housing body 16 to be stored in a fluid reservoir (not shown).

In a condition where the component parts of the axial plunger pump or motor have been assembled, the swash plate 28 is retained in a position inclined at the maximum angle under the load of compression coil spring 32 acting on the thrust piston 30, the valve element 41 of pressure control valve assembly 39 is maintained in the first position under the load of compression coil spring 40 to interrupt the fluid communication between the passages 42A, 42B and 44A, 44B, and the valve element 50 is maintained in engagement with the support plate 52 under the load of compression coil spring 49 to close the axial hole of support plate 52.

Assuming that the drive shaft 18 is driven to rotate the cylinder barrel 19, frictional engagement of the plunger shoes 29 on the inclined swash plate 28 starts the pumping action by reciprocating the plungers 26 in the barrel cylinders 27. Thus, hydraulic fluid from inlet passage 24 is sucked into the barrel cylinders 27 through the suction slot 22 of valve plate 21 and is consequently discharged at a high pressure from the barrel cylinders 27 into the outlet passage 25 through the discharge slot 23 of valve plate 21. In this instance, the valve elements 41 and 50 each are applied with the hydraulic fluid under pressure from the outlet passage 25 through the passages 44B, 44A. When the hydraulic pressure acting on the valve element 50 exceeds the predetermined value, the valve element 50 is moved leftward against the load of compression coil spring 49 to permit the flow of hydraulic fluid supplied into the housing cavity 15A through the axial hole of support plate 52 and is brought into engagement with the valve seat 51. As a result, the housing cavity 15A is filled with the hydraulic fluid supplied thereto from the outlet passage 25 during leftward movement of the valve element 50 for lubrication of sliding portions between the cylinder barrel 19 and valve plate 21 and between the swash plate 28 and plunger shoes 29.

When the hydraulic pressure acting on the valve element 41 exceeds the predetermined value, the valve element 41 is moved against the load of compression coil spring 40 to supply the hydraulic fluid under pressure into the fluid chamber 38 through the passages 44A, 42A and 42B. As a result, the hollow piston 36 is moved leftward by the hydraulic pressure applied thereto against the pressure acting on the thrust piston 30 to minimize the inclined angle of swash plate 28 thereby to minimize the discharge amount of hydraulic fluid into the outlet passage 25. When the pressure in outlet passage 25 drops below the predetermined value defined by the load of compression coil spring 40, the valve element 41 is returned to the first position to interrupt the communication between passages 44A and 42A and to permit the hydraulic fluid discharged from the fluid chamber 38 into the housing cavity 15A through passages 42A, 43A and 43B. Thus, the swash plate 28 is inclined by the pressure acting on the thrust piston 30 and retained at the maximum angle to maximize the discharge amount of hydraulic fluid into the outlet passage 25. As is understood from the above description, the pressure of hydraulic fluid discharged into the outlet passage 25 is maintained at the predetermined value under control of the pressure control valve 39. When the drive shaft 18 is stopped, the pressure in outlet passage 25 drops, and in turn, the valve element 50 of fluid control valve assembly 48 is brought into engagement with the support plate 52 under the load of compression coil spring 49 to interrupt the flow of hydraulic fluid into the housing cavity 15A from the passage 44B.

From the above description, it will be understood that the housing cavity 15A is automatically filled with the hydraulic fluid supplied thereto from the outlet passage 25 through the fluid control valve assembly 48 at an initial stage in operation. This means that the housing cavity 15A is filled with the hydraulic fluid for lubrication without any manual operation to provide the axial plunger pump or motor at a low cost. At the initial stage in operation, the air sucked into the barrel cylinders 27 from inlet passage 24 is exhausted with the hydraulic fluid supplied into the housing cavity 15A. This is useful to eliminate deterioration of the pumping efficiency caused by the air in hydraulic fluid. Additionally, the hydraulic fluid supplied in excess into the housing cavity 15A is successively discharged through the discharge holes 53. This is effective to refresh the hydraulic fluid for lubrication.

In an experiment where the axial plunger pump was operated at the rotational speed of 1800 rpm to discharge hydraulic fluid under pressure of 70 kg f/cm$^3$, it has been confirmed that the housing cavity 15A was sufficiently filled with the hydraulic fluid supplied thereto from the outlet passage 25 after lapse of several minutes at the initial stage in operation. After lapse of 100 hours in operation, the axial plunger pump was disassembled to confirm the condition of sliding portions between the cylinder barrel and valve plate and between the plunger shoes and swash plate. In this case, any seizure was not found at the sliding portions.

What is claimed is:

1. A hydraulic pump or motor having a rotary cylinder barrel formed with a plurality of cylinders in which a corresponding number of plungers are axially slidably disposed for reciprocation, a valve plate in frictional engagement with an end face of said cylinder barrel and being formed with a suction slot and a discharge slot to be communicated with the cylinders of said barrel, and a housing formed with a cavity containing therein said cylinder barrel, said housing having an end wall formed with an inlet passage in open communication with the suction slot of said valve plate and an outlet passage in open communication with the discharge slot of said valve plate, wherein a fluid control valve assembly is disposed in the end wall of said housing to permit the flow of hydraulic fluid supplied therethrough into the cavity of said housing from said outlet passage when applied hydraulic fluid pressure is higher than a predetermined value and to interrupt the flow of hydraulic fluid supplied into the cavity of said housing in response to a further increase of hydraulic fluid pressure applied thereto, and wherein a peripheral wall of said housing has a discharge hole to discharge the hydraulic fluid supplied in excess into the cavity of said housing from said outlet passage under control of said fluid control valve assembly.

2. A hydraulic pump or motor as claimed in claim 1, wherein said housing is composed of a housing body closed by an end wall block secured thereto to form a cavity containing therein said cylinder barrel, said end wall block being formed with said inlet and outlet passages and an axial bore having one end in open communication with said outlet passage and the other end in open communication with the cavity of said housing body, and wherein said fluid control valve assembly is disposed within the axial bore of said end wall block.

3. A hydraulic pump or motor as claimed in claim 2, wherein said fluid control valve assembly comprises a valve seat disposed within the axial bore of said end wall block to permit the flow of hydraulic fluid supplied therethrough into the cavity of said housing body from said outlet passage and a spring loaded valve element arranged to interrupt the flow of hydraulic fluid supplied into the cavity of said housing body by engagement with said valve seat when applied with the pressure of hydraulic fluid higher than a predetermined value.

* * * * *